United States Patent [19]

Hanau

[11] Patent Number: 4,534,548

[45] Date of Patent: Aug. 13, 1985

[54] BACON SLICING MACHINE

[76] Inventor: Fernand Hanau, 15 Blvd. Flandrin, 75016 Paris, France

[21] Appl. No.: 549,734

[22] Filed: Nov. 8, 1983

[30] Foreign Application Priority Data

Nov. 12, 1982 [FR] France ..... 82 18983

[51] Int. Cl.[3] ..... B65H 39/02; B65B 35/30

[52] U.S. Cl. ..... 270/58; 53/DIG. 1; 53/389; 53/537; 53/157; 17/52

[58] Field of Search ..... 270/58; 17/52; 53/DIG. 1, 389, 537, 157, 435, 461, 509, 531, 540, 170

[56] References Cited

U.S. PATENT DOCUMENTS

| | | | |
|---|---|---|---|
| 2,760,871 | 8/1956 | Hensgen et al. | 53/DIG. 1 |
| 2,877,120 | 3/1959 | Bush | 53/389 |
| 2,907,152 | 10/1959 | Hensgen et al. | 53/DIG. 1 |
| 3,001,352 | 9/1961 | Harrison | 53/389 |
| 3,019,578 | 2/1962 | Cohen | 53/DIG. 1 |
| 3,772,040 | 11/1973 | Benson et al. | 53/389 |
| 3,849,969 | 11/1974 | Paules | 53/389 |
| 3,851,442 | 12/1974 | Miles | 53/389 |
| 4,020,614 | 5/1977 | Smithers | 53/DIG. 1 |
| 4,041,676 | 8/1977 | Smithers | 53/DIG. 1 |
| 4,452,031 | 6/1984 | Dennis et al. | 53/DIG. 1 |

FOREIGN PATENT DOCUMENTS

| | | | |
|---|---|---|---|
| 3115771 | 11/1982 | Fed. Rep. of Germany | 17/52 |
| 2082967 | 3/1982 | United Kingdom | 17/52 |

*Primary Examiner*—E. H. Eickholt

*Attorney, Agent, or Firm*—Oblon, Fisher, Spivak, McClelland & Maier

[57] ABSTRACT

The invention provides a bacon slicing machine which synchronizes the cutting and laying of bacon on a reception plate with a sheet of non adherent material layed between two successive cut slices of bacon.

21 Claims, 3 Drawing Figures

BACON SLICING MACHINE

BACKGROUND OF THE INVENTION

1. Field of the Invention

The present invention relates to bacon slicing or to bacon slicing machines.

A bacon slicing machine cuts up the "bacon", i.e. the fat with skin, just as it comes from the pig, into sheets a few millimeters thick, called "slices" which are used for covering with a strip of fat a piece of meat, meat paste, poultry or a piece of game, for example.

2. Description of the Prior Art

Known bacon slicing machines comprise a horizontal reception plate on which is placed the bacon to be cup up, a drive cylinder disposed transversely above or below the bacon, which cylinder, preferably grooved, catches on the bacon and urges it against a cutting device acting in the horizontal plane situated above the plane of the reception plate at a distance corresponding to the desired thickness of the bacon slices.

This distance is obtained by adjusting the height of the reception plate with respect to the cutting system.

Under the cutting device is provided a horizontal or substantially horizontal shelf or receptacle which receives the bacon slices.

The cutting device is generally a circular blade having sufficient diameter for cutting the bacon slices over the whole of their width.

In some bacon slicing machines of the prior art, this cutting device is an endless blade about two meters long.

A first disadvantages of the machines of the prior art resides in the fact that the bacon slices are piled up on one another on the tray, that they stick together and catch on to each other and, considering their thinness and fragility, they are damaged and thus cause not inconsiderable losses during the operations.

SUMMARY OF THE INVENTION

A first aim of the invention is to overcome this disadvantage by providing a bacon slicing machine comprising a plate for receiving a piece of bacon laid flat, a means situated transversely above said reception plate for driving the piece of bacon with a translational movement, driving means causing the piece of bacon to advance against a cutting device acting in a plane parallel to the reception plate, situated above and at a distance from said plate corresponding to the thickness of a bacon slice, a plate for removing the cut slices of bacon, a reception plate for the cut slices of bacon and means for placing a sheet of non adherent material between two successive slices of bacon on the bacon reception plate.

Said means for placing a sheet of non adherent material are advantageously formed by a roll holder for supporting a strip of non adherent rolled-up material, a means for advancing said strip at the outlet of the roll-holder, means for guiding said strip to the bacon reception plate, a device for severing said strip so as to obtain a sheet of a length substantially equal to that of the slices of bacon, the means for driving the strip of non adherent material and the means for driving the piece of bacon being speed synchronized and coupled together so as to cause the strip of non adherent material to advance at a speed substantially equal to that of the piece of bacon.

Preferably, the means for driving the piece of bacon are formed by a drive cylinder rotated and mounted on a support arm movable in the direction perpendicular to the plane of reception of the piece of bacon.

Preferably also, the support arm is rigidly connected to the mobile rod of a control member, of the pneumatic or hydraulic actuator type.

Control of the actuator allows the drive cylinder to be applied against the upper face of the piece of bacon (downward movement) or to be moved away from said face (upward movement).

Also preferably, the means for driving the strip of non adherent material are formed by two rollers between which said strip is nipped: a freely rotatable counter-roller and a drive roller rotated by an independent motor. As a variant, said roller for driving the non adherent material strip may be rotated by a motor for driving the cylinder causing the piece of bacon to advance, by means of an appropriate mechanical coupling known per se.

Also preferably, the action of the device for severing the non adherent material strip is controlled mechanically by the rising movement of the bacon driving cylinder, when the whole length of the piece of bacon has been advanced.

The severing device is formed by a mobile knife acting against a fixed counter knife, said mobile knife being connected mechanically to the mobile rod of the control means of hydraulic or pneumatic actuator type mentioned above.

Advantageously, a plate is provided for receiving the slices of bacon, disposed under the device for cutting the piece of bacon, sloping with respect to the horizontal, the highest end being the nearest to said cutting means.

This arrangement of the reception plate for the slices of bacon facilitates reception of the slices of bacon which are disposed flat and not more or less rolled up as in the machines of the prior art. Furthermore, the inclined plane of said plate facilitates discharge of the slices of bacon.

In the machine, it is advantageously provided for the bacon reception plate, bacon discharge plate and the bacon slices reception plate to the orientatably and retractably mounted so as to limit the space occupied by said machine.

In an improved embodiment of the invention, the bacon is cut up as far as the fat-skin without manual handling, i.e. without having to pick up the piece of bacon after a slice of bacon has been cut off, the slices of bacon being automatically cut off, stacked and separated by a sheet of non adherent material.

To attain this end, the machine of the invention comprises a first and second plate for receiving a piece of bacon laid flat, situated on each side of a double-acting cutting device, acting in a plane parallel to said reception plates and situated above said plates at a distance corresponding to the thickness of a slice of bacon, first and second means for driving the piece of bacon, situated transversely and above respectively the first and second reception plates, to cause said piece of bacon to advance against the cutting device, alternately on one side and on the other of said cutting device, a carriage for receiving the cut off slices of bacon, and means for placing a non adherent material sheet between two successive slices of bacon on the bacon slice reception carriage.

Preferably said means for laying a non adherent material sheet between two successive slices of bacon are formed by first and second laying means, associated respectively with the first and second means for driving the piece of bacon, each comprising a roll holder made from a non adherent material in the form of a rolled up strip, means for driving said strip at the outlet of the roll-holder to the bacon slice reception carriage, a device for severing said strip so as to obtain a sheet of a length substantially equal to that of the slices of bacon, the advance of each strip of non adherent material being synchronized with and of the same speed as the advance of the piece of bacon over the corresponding reception plate.

Means are advantageously provided for alternating the starting up of the symmetric means for advancing the piece of bacon.

The means for advancing the piece of bacon against one or other of the cutting edges of the cutting device alternately, are formed by two drive cylinders mounted on a support arm whose position in the direction perpendicular to the piece of bacon reception plates may be modified.

For this, the drive cylinders are supported by a support arm rigidly connected to the mobile rod of a control member of the pneumatic or hydraulic actuator type.

Similarly to the first embodiment, the first drive means and the second drive means for a first strip of non adherent material, respectively of a second strip of non adherent material, are each formed by a freely rotating counter roller, a drive roller which presses against the corresponding counter roller for advancing the corresponding strip of non adherent material.

The action of each drive roller is synchronized with the action of the corresponding bacon advancing cylinder.

Similarly, each severing device is controlled by the rise of the corresponding bacon advancing cylinder.

Advantageously, in a second embodiment of the invention, a reception carriage movable in translation is provided under the reception plates for receiving the slices of bacon, alternately from the first plate and from the second plate, which carriage follows the movement of the piece of bacon, at the same speed as this latter.

The non adherent material may be paper.

The device for cutting the piece of bacon will be advantageously in all the embodiments of the invention a vibrating blade. This vibrating blade will be a single acting blade in the machine according to the first embodiment of the invention and a double-acting vibrating blade in the automatic machine without manual handling between two bacon slices.

A vibrating blade is extremely easy to mount and dismantle, since it is simple fastened by end holes on corresponding studs of a blade holder.

Advantageously, the machine according to any one of the embodiments of the invention has a vibrating blade which is disposable after use, thus requiring no sharpening as is the case for circular blades or band blades.

Besides the preceding arrangements, the invention also comprises other arrangements, which will be clear from the following description.

BRIEF DESCRIPTION OF THE DRAWINGS

The invention will be better understood from the complement of description which follows with reference to the accompanying drawings in which.

It will of course be readily understood that the drawings and the corresponding descriptive parts are given solely by way of illustration of the subject of the invention, of which they form in no wise a limitation.

DESCRIPTION OF THE PREFERRED EMBODIMENTS

Figures 1, 1A:
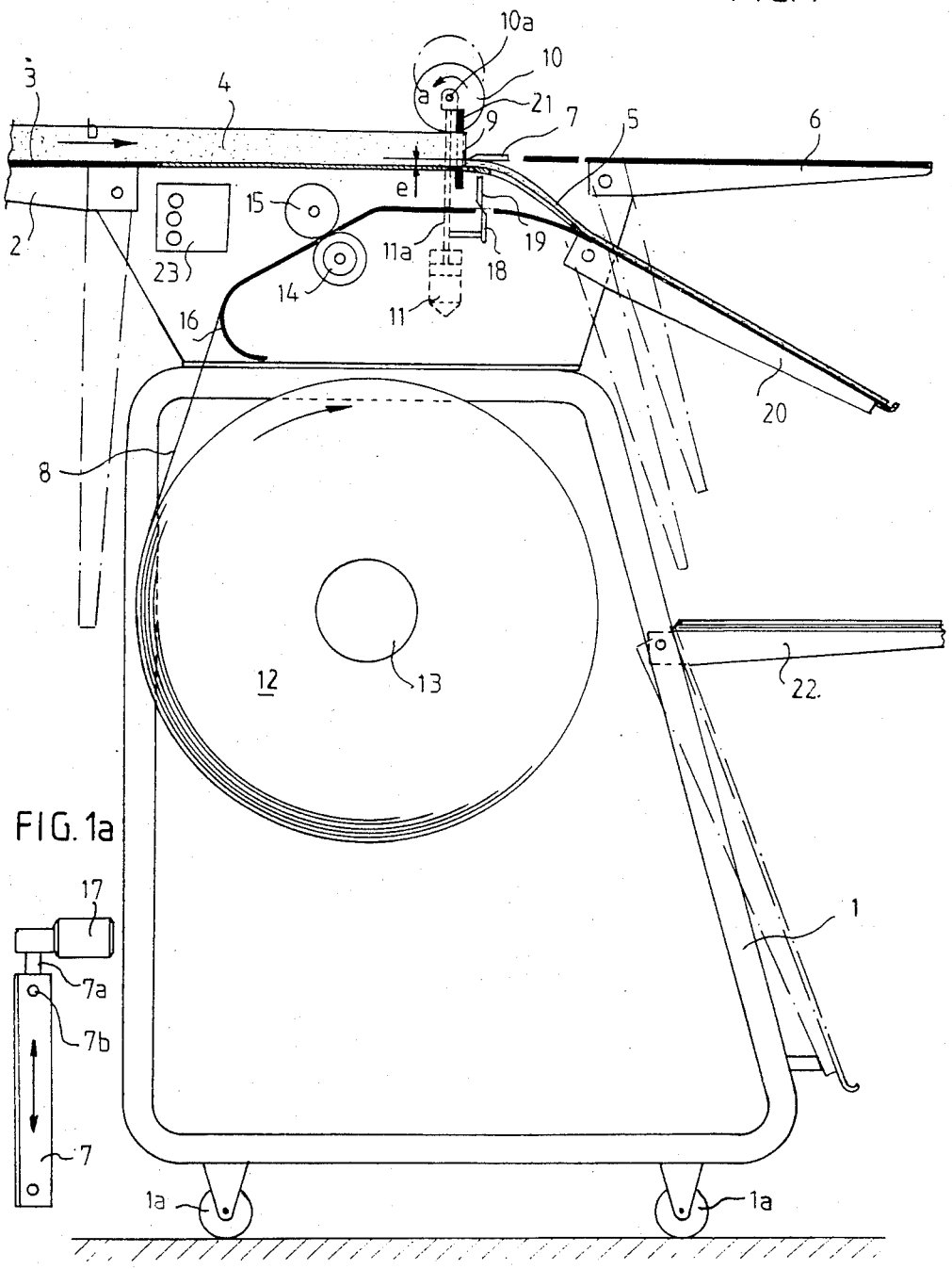
FIG. 1 is a schematical sectional view of a first embodiment of the invention.

The bacon slicing machine shown in FIG. 1 comprises a frame 1, generally of tubular shape, movable by means of wheels 1*a*, a reception table 2 for the piece of bacon to be cut up 4, which table defines at its upper part a plate 3 for receiving the piece of bacon and a discharge table 6 for the cut up slices of bacon.

Between the reception table 2 and the discharge table 6 is disposed a transverse vibrating blade 7 with a cutting edge 9 removed from the plane of plate 3 by a distance e corresponding to the desired thickness of a bacon slice 5. The distance e may be obtained either by moving the vibrating blade 7 with respect to the reception plate 3 or, preferably, by moving the reception table 2 in the vertical direction with respect to the horizontal plane of the cutting edge 9 of the vibrating blade 7.

This movement of the reception table 2 may be obtained by any appropriate known means, such as a screw-nut system or a hydraulic or pneumatic system for example.

A control device not shown, known per se, provides for adjusting and visualizing the desired cutting thickness e.

The vibrating blade 7 is fastened at both its ends to a blade holder 7*a* which is reciprocated, by any means known per se, from a motor 17 driving the vibrating blade.

The vibrating blade may very simply be hooked on to the blade holder by means of end holes 7*b* (cf FIG. 1*a*).

The piece of bacon is applied and urged against the cutting edge 9 of the vibrating blade 7 by means of a bacon advancing mechanism comprising a drive cylinder 10 rotated in the direction of arrow a so as to cause the piece of bacon to advance in translation in the direction of arrow b.

The peripheral surface of the drive cylinder 10 has preferably grooves or equivalent means for providing efficient driving of the piece of bacon 4 by catching on to the upper face of the piece of bacon.

Drive cylinder 10 is mounted for vertical translational movement. The height of the drive cylinder is controlled by the action of a hydraulic or pneumatic actuator, whose mobile part 11*a* is connected mechanically to the shaft 10*a* of said drive cylinder.

Actuator 11 is controlled in a way known per se so as to move the drive cylinder 10 in the vertical direction, in particular for applying this latter against the upper face of the piece of bacon 4 during cutting thereof.

The actuator is dimensioned so as to allow two endmost positions of the drive cylinder; a high position stop and a low position stop. In the low position, the drive cylinder 10 is prevented from touching the bacon reception plate 3.

The drive cylinder 10 is rotated by a drive motor, not shown.

The machine also comprises means for supplying, advancing, cutting and laying a sheet of paper of length and width substantially equal to the length and width of a slice of bacon. These means comprise a paper roll 12, of width substantially equal to that of the slices of bacon, mounted freely rotating on a roll holder 13, rollers 14 and 15 for advancing the paper strip 8, a flange 16 for guiding said strip towards said advancing rollers, means for severing the paper strip 8 formed by a mobile knife 18 cooperating with the fixed knife 19, which severing means are disposed upstream of a plate 20 receiving the slices of bacon.

The rollers for advancing the paper strip comprise a counter roller 14, mounted freely rotatable, and a drive roller 15, driven with a rotational movement, which may be pressed against the counter roller 14 to cause the paper strip 8 to advance. Drive roller 15 may be moved away from its position against the counter roller 14, so as to allow the paper strip to be inserted when loading paper into the machine.

The means for rotating the bacon drive cylinder 10 and the means for driving the paper strip drive roller 15 are advantageously coupled, in a way known per se, so as to establish the same advancing speed for the piece of bacon and the strip of paper.

Also preferably, said two drive movements are controlled by the same motor.

The use of the same motor allows synchronization of the movement of the piece of bacon 4 and the movement of the paper strip 8, so that said paper strip 8 only moves when the piece of bacon 4 is moving, said synchronization being easily obtained by the "on-off" control of said drive motor.

The movement of the mobile blade 18 against the fixed blade 19 for severing the paper strip 8 is achieved simultaneously with the rise of the drive cylinder 10 under the action of actuator 11, set in action by a signal given by a means 21 detecting the end of the passage of the piece of bacon.

The purpose of detection system 21 is to detect the end of the passage of the piece of bacon. This system may be formed for example by a photoelectric cell.

Besides the reception plate 20 for the bacon slices, a recovery plate 22 is also provided.

The bacon reception table 2, the bacon recovery table 6 and bacon reception 20 and recovery 22 plates are mounted retractable for rotation about their end connected to the frame of the machine so as to reduce the space occupied by said machine when not in use.

A control panel 23, shown schematically, carries the control buttons for the operating cycle of the machine.

Operation of the machine is as follows: the operator lays a piece of bacon 4 flat on the reception plate 3 of table 2. Adjustment of the cutting thickness e is obtained by moving the reception table 2 in the vertical direction. As a variant, the vibrating blade 7 could also be moved with respect to the fixed table 2.

Then, the piece of bacon is advanced until it comes into abutment against the cutting edge 9 of the vibrating blade 7.

A paper roller 12 is placed on the roll-holder 13. The end of the rolled paper strip is inserted between the counter roller 14 and the drive roller 15: this operation is facilitated by manually raising the drive roller 15 which is brought into contact position with the counter roller by the action of a simple resilient return means, such as a spring, not shown.

The operating cycle of the machine only begins when the detection system 21 detects the presence of the piece of bacon in the cutting position.

The drive cylinder 10 is lowered so that it comes into contact against the upper face of the piece of bacon and exerts thereon a predetermined force. This downward movement of the drive cylinder 10 results in the downward movement of the mobile knife 18 for severing the paper strip. The operator inserts the free end of paper strip 8 between the fixed knife and the mobile knife, separated from each other.

The drive motor common to the means for driving the piece of bacon 4 and the means for driving the paper strip 8 is then started up. The piece of bacon 4 is urged against the cutting edge of the vibrating blade 7 and the paper strip is advanced over the reception plate 20.

A slice of bacon 5 is cut, of thickness e, and falls on to the reception plate 20, previously covered with a paper strip.

The end of the passage of the piece of bacon is detected by the detection system 21 whose signal causes the drive cylinder 10 to rise and simultaneously the mobile knife 18 to rise against the fixed knife 19, the rise of the mobile knife causing the paper strip 8 to be severed.

The rise of the drive cylinder 10 and of mobile knife 10 is provided by the actuator 11, after the common motor for driving the piece of bacon and advancing the paper has stopped.

Bacon slice 5 placed on the sheet of paper 8 on the bacon reception plate 20, whereas the remaining piece of bacon is pushed over the bacon recovery table 6. The bacon slices 5 separated by paper sheets are then stacked on the recovery plate 22.

It goes without saying that the different phases of the operating cycle properly speaking (downward movement of the drive cylinder, starting up of the advancing movement of the piece of bacon and of the paper, stopping of said movement, rise of the drive cylinder and severing of the paper) may be automated by electronic or electric means in a way known per se.

A manual control may also be provided for said movements.

With this machine, the operator is not obliged to manually insert a sheet of paper between two successive bacon slices.

To obtain a second bacon slice, the operator takes up the piece of bacon from reception table 6 and places it again on plate 3 of table 2, for a new cutting cycle identical to the one which has just been described.

Automation of such a so-called single-acting machine may be achieved in a simple way, known per se, the operating cycle being:

- switching on of the machine
- starting up of the machine (beginning of the cycle)
- beginning of the cycle enabled by the detection signal of the presence of the piece of bacon 4 in a proper position on the reception plate 3
- downward actuation of the actuator resulting in lowering of drive cylinder 10 against the upper face of the piece of bacon and simultaneously opening of the paper severing device 18,19
- starting up of the drive motors
- simultaneous advance of the piece of bacon 4 in translational movement against the vibrating blade and of the paper strip 8 towards the bacon reception plate 20 reciprocation of the cutting blade detection of the end of the passage of the piece of bacon causing:

stopping of the drive motors upward movement of the actuator for cutting the paper and downward movement of the cylinder driving the piece of bacon end of cycle.

Figure 2:
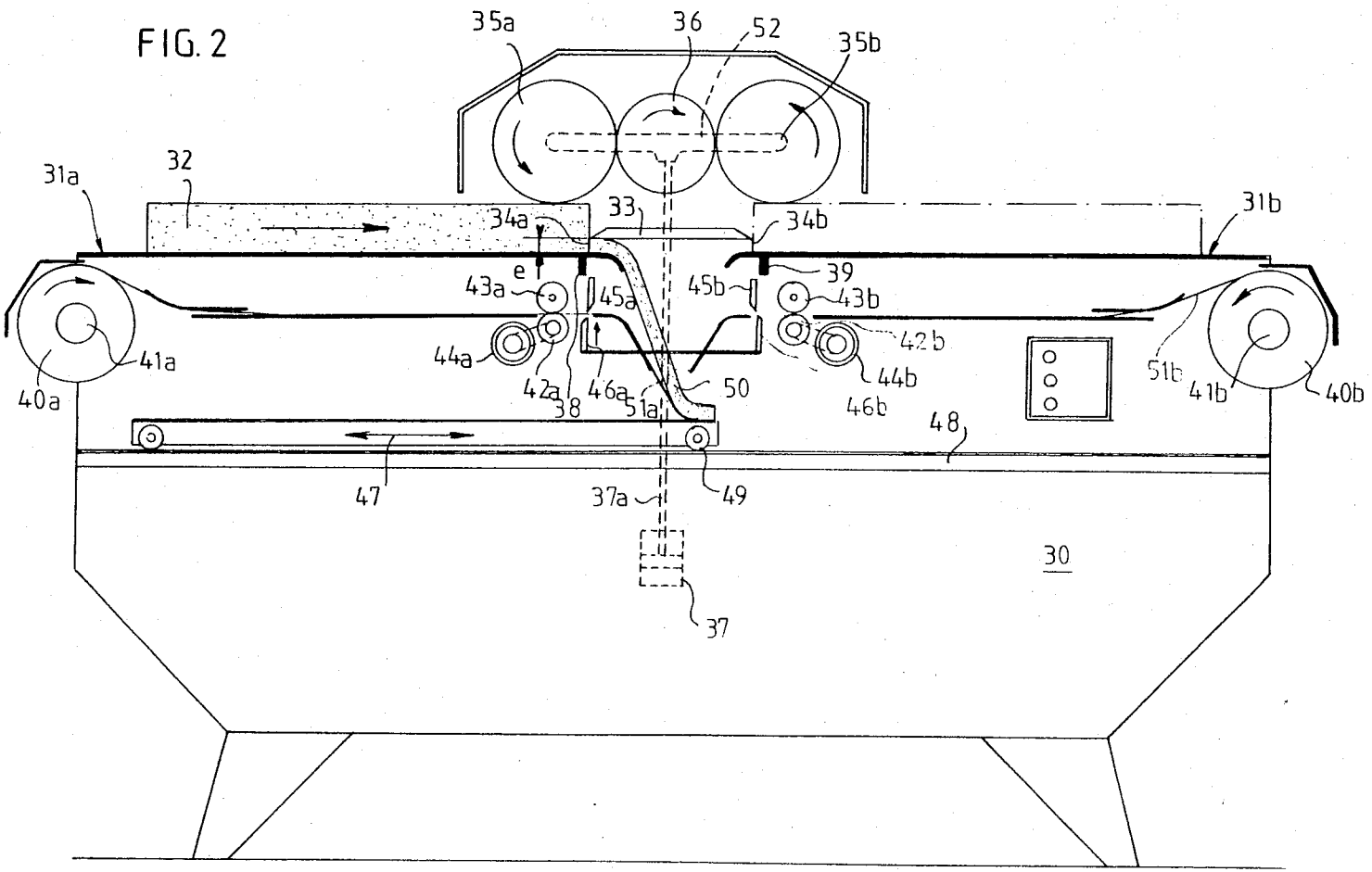
FIG. 2 is a schematical sectional view of a second embodiment of the invention for alternating uninterrupted operation.

In the drawing of FIG. 2 has been shown a second embodiment of the invention having a movement for cutting the piece of bacon in two directions, alternately and avoiding the operator having to convey the piece of bacon from the recovery table to the bacon reception table, for cutting another bacon slice.

The machine according to this second embodiment provides automatic cutting of the piece of bacon up to the fat-skin without manual intervention.

The machine comprises a frame 30 shown schematically, with two tables 31*a* and 31*b* for receiving a piece of bacon 32.

The reception tables are disposed on each side of a cutting means, formed by a double-acting vibrating blade 33. This double-acting vibrating blade may also be replaced by two single-acting vibrating blades.

The cutting means have two cutting edges 34*a* and 34*b* directed respectively towards the reception table 31*a* and reception table 31*b*.

The position of each reception table 31*a*,31*b* may be adjusted in height, so as to select a thickness e of the bacon slices to be obtained, referenced 50.

Means for advancing the piece of bacon 32 are provided for causing the piece of bacon to advance against one or other cutting edge 34*a*,34*b* of the vibrating blade 33.

These means comprise a first cylinder 35 for advancing the piece of bacon 32 over the reception table 31*a* and a second cylinder 35*b* for advancing the piece of bacon 32 over the reception table 31*b*.

A central cylinder 36, connected directly to a drive motor which may be controlled in one or other direction of rotation, is inserted kinematically between the two drive cylinders 35*a* and 35*b*.

The assembly for advancing the bardiere, formed by the three above-mentioned cylinders, may be moved vertically under the action of an actuator 37.

Means for detecting the passage of the piece of bacon are provided respectively at 38 and 39.

Two means for placing a paper sheet are provided, associated respectively with the first and second reception tables of the machine.

With the first table 31*a* for receiving the piece of bacon are associated a paper roll 40*a* mounted on a roll-holder 41*a* for a first paper strip 51*a*, rollers 42*a*,43*a* for advancing said paper strip, and a device 45*a*,46*a* for severing the paper strip.

Similarly, with the second reception table 31*b* are associated a supply roll 40*b*, mounted on a roll-holder 41*b* for a second paper strip 51*b*, advancing rollers 42*b*,43*b* and a device 45*b*,46*b* for severing the paper strip 51*b*.

Each paper laying means operates in the way described above with respect to the machine of FIG. 1.

Rollers 42*a* and 42*b* are drive rollers whereas rollers 43*a* and 43*b* are counter rollers, mounted freely rotating.

In the drawing of FIG. 2, there are shown motors 44*a* respectively 44*b*, for rotating the drive rollers 42*a*, respectively 42*b*. As a variant a single motor may be used with rotation in both directions for alternately driving the two paper strips 51*a* and 51*b* and for driving the cylinders 35*a* and 35*b* for advancing the piece of bacon, said motor being actuatable in one or other direction of rotation according to the operating cycle of the machine, which will be described further on.

The drive rollers 42*a*,42*b* for driving the paper strips are speed coupled with cylinders 35*a*,35*b* for advancing the piece of bacon, so as to cause the paper strips to advance at the same speed as the piece of bacon.

Such speed coupling is achieved in a simple way known per se, by selecting the rotational speed of the drive motors, or in the case of a single drive motor, by providing an appropriate mechanical connection, known per se.

The severing devices 45*a*,46*a*, respectively 45*b*,46*b* are actuated by the rise of the bacon advancing assembly.

The mobile knives 46*a*,46*b* are connected mechanically to the mobile part of actuator 37, and are thus moved upwardly against the respective fixed knives 45*a*,45*b*, when the bacon advancing assembly rises.

In a novel way with respect to the embodiment of figure 1, the machine shown in FIG. 2 comprises a receiving carriage 47 movable in translation under the reception tables 31*a* and 32*b* and receiving the bacon slices, alternately from reception table 31*a* and from reception table 31*b*.

This receiving carriage moves over a rail 48, for example, by means of wheels 49.

Automatically the translational movement of the receiving carriage 47 follows the movement of the piece of bacon 32 so as to collect alternately a bacon slice on reception table 31*a* and a bacon slice on reception table 31*b*, each bacon slice being collected on a sheet of paper cut by one or other of the two above-described identical and symmetrical severing devices.

The alternating translational movement of the carriage 47 is coupled to the advancing movement of the piece of bacon by any appropriate mechanical means known per se. Preferably, a single motor controls the advancing movement of said carriage 47 and the bacon advancing cylinders 35*a*,35*b*.

The machine shown in FIG. 2, called automatic or double-acting machine, operates in the following way:

The operator places a piece of bacon 32 flat on one of the reception tables 31*a* or 31*b*, for example table 31*a*.

With the two paper sheet laying means supplied, the operating cycle will be the following:

The piece of bacon 32 is applied against the cutting edge 34 a of the vibrating blade 33. A first detection system 38 detects the presence of the piece of bacon in the correct position, and enables the cycle properly speaking to begin. Drive assembly 35*a*,36,35*b* descends under the action of actuator 37, so as to apply cylinder 35*a* against the upper face of the piece of bacon 32. Simultaneously, the downward movement of the mobile rod of the actuator causes the paper severing devices to open, i.e. a downward movement of mobile knives 46*a*, 46*b*. The starting up of the drive motor or motors controls the simultaneous advance of the piece of bacon 32 against the vibrating blade 33, paper strip 51*a* and the advance of the receiving carriage 47. When the piece of bacon has been cut over the whole of its length, a bacon slice of thickness e falls on to the receiving carriage 47, separated from the upper face of the carriage by a paper strip. The detection system 38 detects the end of the passage of the piece of bacon and causes the drive motor or motors controlling the advance of the piece of bacon, of the paper strip 51*a* associated with the first reception table 31*a* and the receiving carriage 47 to stop and, on the other hand, the drive cylinders and mobile knives 46*a*,46*b* to rise. Rising of the mobile knives causes the paper strip to be severed.

The piece of bacon 32 is then placed flat on the second reception plate 31*b*. The reverse operating cycle begins, with reversal of the drive motors allowing movement of the piece of bacon and of the receiving carriage in the reverse direction.

What is claimed is:

1. A bacon slicing machine comprising a plate for receiving a piece of bacon laid flat, a means for driving said piece of bacon in translation, formed more especially by a cylinder driven in rotation, and situated transversely and above said reception plate, which drive means causes said piece of bacon to advance against a cutting device acting in a plane parallel to said reception plate, situated above and at a distance from said plate corresponding to the thickness of a bacon slice, a plate for receiving bacon slices and a plate for recovering the piece of bacon, said machine further comprising a means for laying on the bacon reception plate a sheet of non adherent material between two successive bacon slices.

2. The machine as claimed in claim 1, wherein said means for laying a sheet of non adherent material between two successive bacon slices is formed by a roller feeding said non adherent material in the form of a strip, a means for driving said strip at the outlet of the feed roller towards said bacon reception plate, a device for severing said strip so as to obtain a sheet of length substantially equal to that of the bacon slices, the advancing speed of the piece of bacon being equal to the advancing speed of said strip of non adherent material.

3. The machine as claimed in claim 2, wherein the movement of the means driving said strip of non adherent material is synchronized with the movement of said bacon advancing means so that said non adherent material strip is only moving when the piece of bacon is moving.

4. The machine as claimed in any one of claims 1 to 3, wherein said drive cylinder, driven in rotation, may be moved in vertical translation under the action of application means moving said drive cylinder against or a way from the upper face of the piece of bacon.

5. The machine as claimed in any one claims 2 to 3, wherein said means for driving said non adherent material strip is formed by two rollers between which said strip passes: a counter roller mounted freely rotating and a drive roller, driven in rotation, the counter roller pressing against the drive roller for advancing said strip.

6. The machine as claimed in claim 4, wherein said means for applying said drive cylinder are formed by a hydraulic or pneumatic actuator whose mobile part is connected rigidly to the shaft of said bacon drive cylinder, so as to move said drive cylinder in the vertical direction.

7. The machine as claimed in any one of claims 2 to 3, wherein the action of said device for severing said non adherent material strip is controlled mechanically by the rise of the bacon drive cylinder, under the action of said drive cylinder application means.

8. The machine as claimed in claim 7, wherein said severing device is formed by a mobile knife acting against a fixed counter knife, said mobile knife being connected mechanically to said bacon drive cylinder and the cutting movement of said mobile knife is controlled by the rise of said drive cylinder.

9. The machine as claimed in any one of claims 1 to 3, wherein said bacon slice reception plate is disposed under said bacon cutting device, inclined with respect to the horizontal, the highest end being the closest to said cutting means.

10. The machine as claimed in any one of claims 1 to 3, wherein said bacon reception plate and said becon reception plate are orientatably and retractably mounted so as to limit the space taken up by said machine.

11. A bacon slicing machine comprising a first and second plate for receiving a piece of bacon laid flat, situated on each side of a double-acting cutting device acting in a plane parallel to said reception plate and situated above said plate at a distance corresponding to the thickness of a bacon slice, a first and second means for driving said piece of bacon, formed more especially by two cylinders, and situated transversely and above respectively the first and second reception plate, so as to cause said piece of bacon to advance against said cutting device, alternately on one side and one the other of said cutting device, which machine further comprises means for laying a non adherent material sheet between two successive bacon slices.

12. The machine as claimed in claim 11, wherein said means for laying a non adherent material sheet between two successive bacon slices are formed by first and second laying means associated respectively with the first and second bacon drive means, each comprising a roller for supplying said non adherent material in the form of a strip, a means for driving the paper strip at the outlet of said supply roller, a device for severing said paper strip so as to obtain a sheet of a length substantially equal to that of the bacon slices, the advancing speed of said non adherent material strips being equal to the speed of advance of the piece of bacon.

13. The machine as claimed in claim 12, wherein means are provided for synchronizing the means for driving said non adherent material strip with the corresponding means for driving the piece of bacon so that each means for driving a non adherent material strip is only moving when the piece of bacon is moving under the action of the corresponding bacon drive means.

14. The machine as claimed in any one of claims 11 to 13, wherein said two bacon advancing means, driven in rotation, are moved in vertical translation under the action of application means.

15. The machine as claimed in claim 14, wherein said application means are formed by a hydraulic or pneumatic actuator whose mobile part is connected rigidly to the support shafts of said drive cylinders.

16. The machine as claimed in any one of claims 11 to 13, wherein means are provided for alternating the direction of rotation of said bacon drive cylinders when the piece of bacon has left one of the two reception plates.

17. The machine as claimed in any one of claims 12 to 13, wherein the first and second means for driving a first non adherent material strip and respectively a second non adherent material strip are each formed by a counter roller, a driven drive roller, which driven drive roller presses the corresponding counter roller for advancing the corresponding non adherent material strip and may be retracted during loading of paper strips into the machine.

18. The machine as claimed in claim 17, wherein the control of said drive rollers is synchronized with the control of said corresponding drive cylinders, so that stopping of the piece of bacon causes the advance of the paper strip to stop.

19. The machine a claimed in any one of claims 12 to 13, wherein each severing device is controlled by the rise of said bacon drive cylinder at the end of the passage of said piece of bacon.

20. The machine as claimed in any one of claims 1 to 3 or 11 to 13, wherein a receiving carriage is provided movable in translation under said reception plates so as to receive the bards, alternately from one plate and from the other, which carriage follows the reciprocal movement of the bardiere, at the same speed as it.

21. The machine as claimed in any one of claims 1 to 3 or 11–13, wherein said cutting device is a vibrating blade to which a reciprocal rectilinear movement is imparted in the transverse direction with respect to the movements of the piece of bacon.

* * * * *